US009896291B2

(12) United States Patent
Sugiyama

(10) Patent No.: US 9,896,291 B2
(45) Date of Patent: Feb. 20, 2018

(54) SHEET CONVEYING APPARATUS AND IMAGE FORMING APPARATUS

(71) Applicant: CANON KABUSHIKI KAISHA, Tokyo (JP)

(72) Inventor: Tadahisa Sugiyama, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/832,008

(22) Filed: Aug. 21, 2015

(65) Prior Publication Data

US 2016/0060058 A1 Mar. 3, 2016

(30) Foreign Application Priority Data

Aug. 29, 2014 (JP) ..... 2014-174821
Jul. 29, 2015 (JP) ..... 2015-149424

(51) Int. Cl.
*B65H 5/36* (2006.01)
*B65H 5/06* (2006.01)
*B65H 9/00* (2006.01)

(52) U.S. Cl.
CPC ..... *B65H 5/36* (2013.01); *B65H 5/062* (2013.01); *B65H 9/006* (2013.01); *B65H 2402/54* (2013.01); *B65H 2404/61* (2013.01); *B65H 2404/63* (2013.01)

(58) Field of Classification Search
CPC ..... B65H 5/36; B65H 9/004; B65H 9/006; B65H 9/008; B65H 2404/74; B65H 2404/741; B65H 2404/7412; B65H 2404/7414; B65H 2404/7431; B65H 2404/7231; B65H 2404/612;
(Continued)

(56) References Cited

U.S. PATENT DOCUMENTS 8,109,507 B2 * 2/2012 Okumura ..... B65H 9/006 271/227
2010/0237554 A1 9/2010 Okumura et al.

FOREIGN PATENT DOCUMENTS

CN 102556705 A 7/2012
CN 102556705 B 11/2014
JP 60197548 A * 10/1985
(Continued)

OTHER PUBLICATIONS

Chinese Office Action issued in corresponding Chinese Application No. 201510536803.3 dated Jul. 5, 2017.

*Primary Examiner* — Luis A Gonzalez
(74) *Attorney, Agent, or Firm* — Fitzpatrick, Cella, Harper & Scinto

(57) ABSTRACT

A sheet conveying apparatus includes a first conveying portion conveying a sheet, a second conveying portion including an abutment portion against which a front end of the sheet conveyed by the first conveying portion abuts and conveying the sheet, a curved guide including a curved portion and forming a curved sheet conveying path between the first and second conveying portions, and a moving portion disposed to overlap widthwise with the curved portion and movable between a projecting position where the moving portion projects to the sheet conveying path and a recede position where the moving portion recedes. The moving portion is moved to from the projecting position to the recede position by being pressed by the sheet as the sheet is conveyed by the first conveying portion in a state in which the front end of the sheet abuts against the abutment portion.

22 Claims, 6 Drawing Sheets

(58) Field of Classification Search
CPC ..... B65H 2404/511; B65H 2404/1314; B65H 2404/693; B65H 2404/694
See application file for complete search history.

(56) References Cited

FOREIGN PATENT DOCUMENTS

| | | | | |
|---|---|---|---|---|
| JP | 03007364 | A | * | 1/1991 |
| JP | 07157146 | A | * | 6/1995 |
| JP | 08-113389 | A | | 5/1996 |
| JP | 08157107 | A | * | 6/1996 |
| JP | 2893540 | B2 | | 5/1999 |
| JP | 2007-131403 | A | | 5/2007 |
| JP | 2007131403 | A | * | 5/2007 |
| JP | 2009274866 | A | * | 11/2009 |
| JP | 2012180176 | A | * | 9/2012 |

* cited by examiner

SHEET CONVEYING APPARATUS AND IMAGE FORMING APPARATUS

BACKGROUND OF THE INVENTION

Field of the Invention

The present invention relates to a sheet conveying apparatus and an image forming apparatus, and more specifically to a configuration for correcting a skew of a sheet.

Description of the Related Art

Conventionally, an image forming apparatus such as a printer, a copier, and a facsimile includes a skew correcting portion conveying a sheet to an image forming portion and correcting a skew of the sheet. As such skew correcting portion, Japanese Patent No. 2893540 proposes an apparatus using a registration roller pair correcting a skew of a sheet and aligning an image formed in the image forming portion with a front end of the sheet. In correcting a skew of the sheet, firstly, the front end of the sheet being conveyed by an upstream conveying roller pair is caused to abut against a nip portion of the registration roller pair being at a stop.

Thereby, the sheet deflects and forms a loop. The front end of the sheet then follows a nip line of the registration roller pair due to stiffness of the sheet, so that the skew of the sheet is corrected. It is noted that after the correction, the image formed in the image forming portion is aligned with the front end of the sheet by adjusting timing for starting to rotate the registration roller pair.

Here, conventionally, there is an apparatus in which a registration roller pair is disposed along a curved conveying path and a loop space is provided so that a loop of the sheet can be formed upstream in the sheet conveying direction of the registration roller pair. Normally, in a case where a conveying path composed of a pair of conveyance guides is curved, the sheet abuts against the registration roller pair in a state partially separated from an outer conveyance guide in the curve direction by stiffness of the sheet itself and then forms a loop in the loop space.

However, because size of the loop formed by the sheet is different depending on the sheet being conveyed, there is a case where an enough loop space cannot be obtained and a skew cannot be corrected.

Then, conventionally, Japanese patent Application Laid-open No. Hei. 8-113389 proposes a sheet conveying apparatus in which a part of the conveyance guide guiding a sheet to the registration roller pair is configured to be swingable. Then, a loop forming area is assured by temporarily receding the conveyance guide, swingable by the loop of the sheet (referred to a 'swingable guide' hereinafter), from the conveying path. The sheet conveying apparatus corrects a skew of the sheet by forming a loop corresponding to a loop amount of the sheet in that area.

However, the sheet conveying apparatus described in Japanese patent Application Laid-open No. Hei. 8-113389 is unable to set a swing force of the swingable guide that enables to form similar loops enabling to correct a skew for both of a non-stiff sheet and a stiff sheet such as a thick sheet and a coated sheet. That is, if the swing force of the swingable guide is set so as to be able to form a loop by the non-stiff sheet, the swingable guide considerably swings by being pressed by a front end part of the sheet before the sheet abuts against the registration roller pair. In such a case, there is a possibility that the sheet deviates out of the conveying path, causing conveyance failures such as jamming and troubles such as scratch and fold.

Still further, if the swing force of the swingable guide is set to be higher, while it allows the stiff sheet to form an adequate loop and to correct a skew, the non-stiff sheet is unable to swing the swingable guide. In this case, because the sheet cannot form an adequate loop, a skew correcting ability drops.

SUMMARY OF THE INVENTION

According to one aspect of the invention, a sheet conveying apparatus includes a first conveying portion conveying a sheet, a second conveying portion including an abutment portion against which a front end of the sheet conveyed by the first conveying portion abuts and conveying the sheet, a curved guide including a curved portion and forming a curved sheet conveying path between the first and second conveying portions, and a moving portion disposed to overlap with the curved portion in a width direction orthogonal to a sheet conveying path and movable between a projecting position where the moving portion projects to the sheet conveying path and a recede position where the moving portion recedes in a direction approaching to the curved guide from the projecting position. The moving portion is moved from the projecting position to the recede position by being pressed by the sheet as the sheet is conveyed by the first conveying portion in the state in which the front end of the sheet abuts against the abutment portion.

Further features of the present invention will become apparent from the following description of exemplary embodiments with reference to the attached drawings.

DESCRIPTION OF THE EMBODIMENTS

Figure 1:
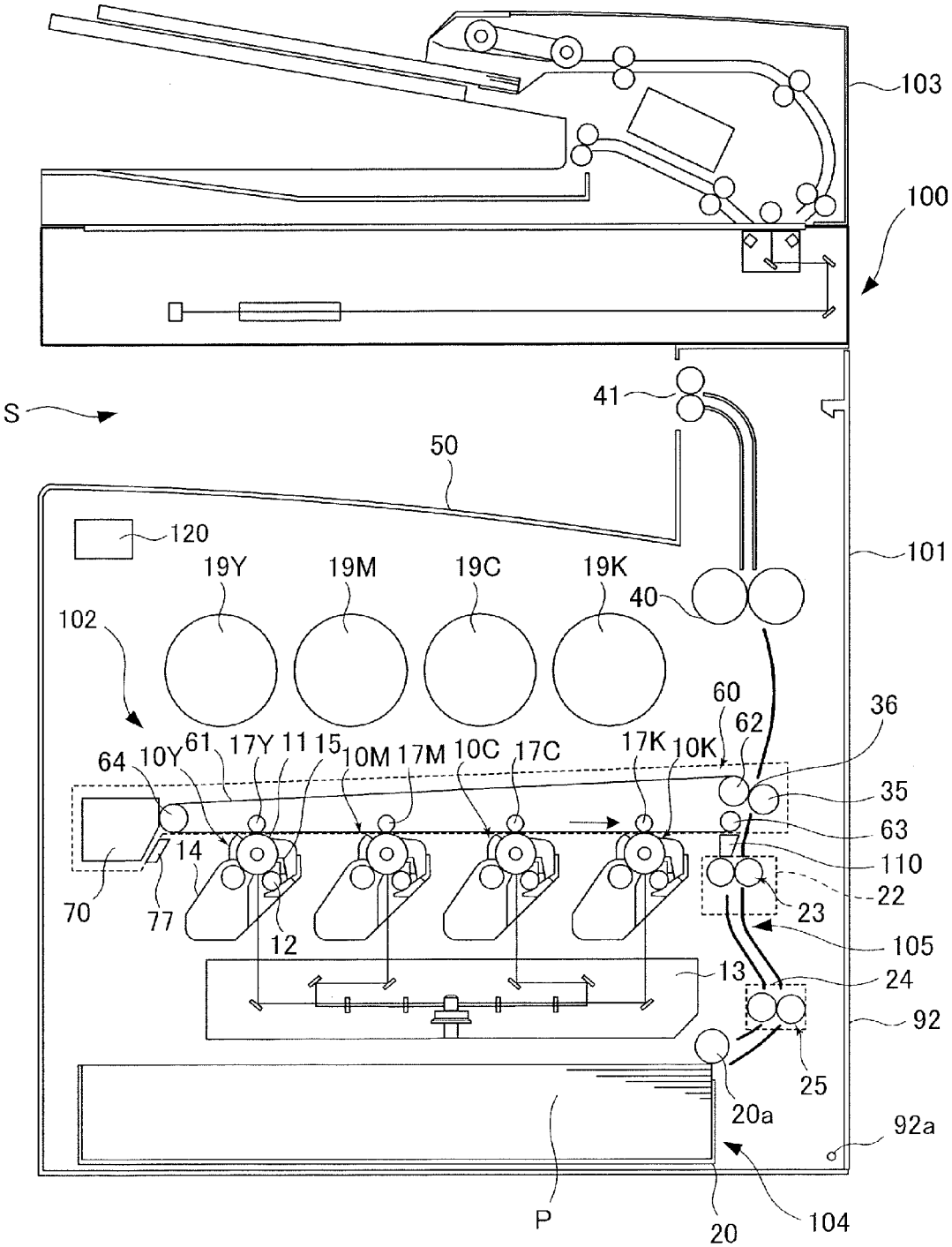
FIG. 1 is a schematic diagram illustrating an entire configuration of a printer, i.e., an exemplary image forming apparatus, including a sheet conveying apparatus of an embodiment.

An embodiment of the invention will be described in detail below with reference to the drawings. FIG. 1 is a schematic diagram illustrating a configuration of a printer, i.e., an exemplary image forming apparatus, including a sheet conveying apparatus of the embodiment of the invention.

As shown in FIG. 1, the printer 100 includes a printer body 101 including an image forming portion 102 and others and an image reading apparatus 103 provided at an upper part of the printer body 101. Formed between the image reading apparatus 103 and the printer body 101 is a sheet discharging space S. The printer body 101 includes the image forming portion 102 and a sheet conveying apparatus 105 conveying the sheet fed by a sheet feeding apparatus 104 to the image forming portion 102. The printer body 101 also includes a control portion 120 controlling an image forming operation of the image forming portion 102 and sheet conveying and skew correcting operations and others of the sheet conveying apparatus 105.

The image forming portion 102 is of a four-drum full-color type and includes a laser scanner 13 and four process cartridges 10Y, 10M, 10C, and 10K forming four color toner images of yellow (Y), magenta (M), cyan (C), and black (K). The image forming portion 102 also includes toner cartridges 19Y, 19M, 19C, and 19K storing toner of the respective colors of yellow (Y), magenta (M), cyan (C), and black (K), and an intermediate transfer unit 60.

Here, because the configuration of the respective process cartridges is the same except of the colors of the toners, only the yellow (Y) process cartridge 10Y will be described below, and an explanation of the process cartridges 10M, 10C, and 10K will be omitted here. The process cartridge 10Y includes a photosensitive drum 11, a charging roller 12, i.e., an electrifying portion, a developing unit 14, and a cleaner 15.

The intermediate transfer unit 60 includes an intermediate transfer belt 61 wrapped around a transfer driving roller 62, a driven roller 63, and a tension roller 64 and rotating in a direction of an arrow in FIG. 1. The intermediate transfer unit 60 also includes primary transfer rollers 17Y, 17M, 17C, and 17K provided inside of the intermediate transfer belt 61 and in contact with the intermediate transfer belt 61 at positions facing the respective photosensitive drums.

Then, the respective negative color toner images on the respective photosensitive drums are sequentially superimposed and transferred onto the intermediate transfer belt 61 by positive transfer bias applied to the intermediate transfer belt 61 through the primary transfer rollers 17Y, 17M, 17C, and 17K. Still further, a secondary transfer outer roller 35 is provided at a position facing the transfer driving roller 62 of the intermediate transfer unit 60. The color image formed on the intermediate transfer belt 61 is transferred to the sheet P by a transfer nip 36 composed of the secondary transfer outer roller 35 and the intermediate transfer belt 61. A fixing portion 40 is disposed above the transfer nip 36, and a sheet discharging roller pair 41 is disposed above the fixing portion 40.

Next, an image forming operation of the printer 100 constructed as described above will be described. At first, image information of the document read by the image reading apparatus 103 is transmitted to the laser scanner 13. It is noted that there is a case when image information is inputted to the image forming portion 102 from an external device such as a personal computer not shown. Then, in the image forming portion 102, the surface of the photosensitive drum 11 of the process cartridge 10Y is scanned by laser light corresponding to the image information of yellow emitted from the laser scanner 13. Thereby, the surface of the photosensitive drum 11 homogeneously electrified with predetermined polarity and potential by the charging roller 12 is sequentially exposed, and a yellow electrostatic latent image is formed on the photosensitive drum 11 of the process cartridges 10Y.

After that, the image forming portion 102 visualizes the electrostatic latent image by developing by the developing unit 14 by using yellow toner and applies primary transfer bias to the primary transfer rollers 17. Thereby, the yellow toner image on the photosensitive drum 11 is transferred onto the intermediate transfer belt 61. In the same manner, the magenta, cyan, and black toner images formed on the respective photosensitive drums of the process cartridges 10M, 10C, and 10K are sequentially superimposed and transferred onto the intermediate transfer belt 61, and a full-color toner image is formed on the intermediate transfer belt 61.

It is noted that the toner left on the photosensitive drum 11 after transferring the toner images on the intermediate transfer belt 61 is removed and recovered by the cleaner 15. Still further, if amounts of the toner of the respective color developing units decrease, toner is replenished from toner cartridges 19Y, 19M, 19C, and 19K.

Still further, in parallel with this toner image forming operation, the sheet P stored in the sheet feeding cassette 20 is fed one by one by a pickup roller 20*a* of the sheet feeding apparatus 104. The sheet P is conveyed by a pre-registration roller pair 25, i.e., a first conveying portion, to a registration unit 22 by passing through a curved conveying path 24, i.e., a curved sheet conveying path, between the pre-registration roller pair 25 and the registration unit 22. The registration unit 22 includes a registration roller pair 23, i.e., an exemplary second conveying portion, conveying the sheet.

The sheet P is subjected to skew correction by abutting the front end thereof against and forming a loop following a nip portion N (abutment portion, see FIG. 3) of a registration roller pair 23. After that, the sheet P whose skew has been corrected is conveyed to the transfer nip 36 by the registration roller pair 23 whose rotation is synchronizing with the toner image on the intermediate transfer belt 61. Then, the color toner image on the intermediate transfer belt 61 is transferred onto the sheet P under predetermined pressure and electrostatic load bias applied at the transfer nip 36.

It is noted that in the present embodiment, a registration detecting unit 110 is disposed between the registration unit 22 and the transfer nip 36. The registration detecting unit 110 reads an image pattern of the toner image on the intermediate transfer belt 61 and corrects drawing of the laser scanner 13 corresponding to inclination of the image. Then, based on a signal from the registration detecting unit 110, the control portion 120 controls the laser scanner 13 such that the toner image on the intermediate transfer belt 61 is straightened up.

After transferring the toner image onto the sheet P, slight residual toner left on the intermediate transfer belt 61 is removed and recovered by a cleaning unit 70. The sheet P onto which the toner image has been transferred is conveyed to the fixing portion 40 and is subjected to heat and pressure in passing through the fixing portion 40 to fix the toner image. After that, the sheet P is discharged on a discharged sheet tray 50 by a sheet discharging roller pair 41.

Figure 2:
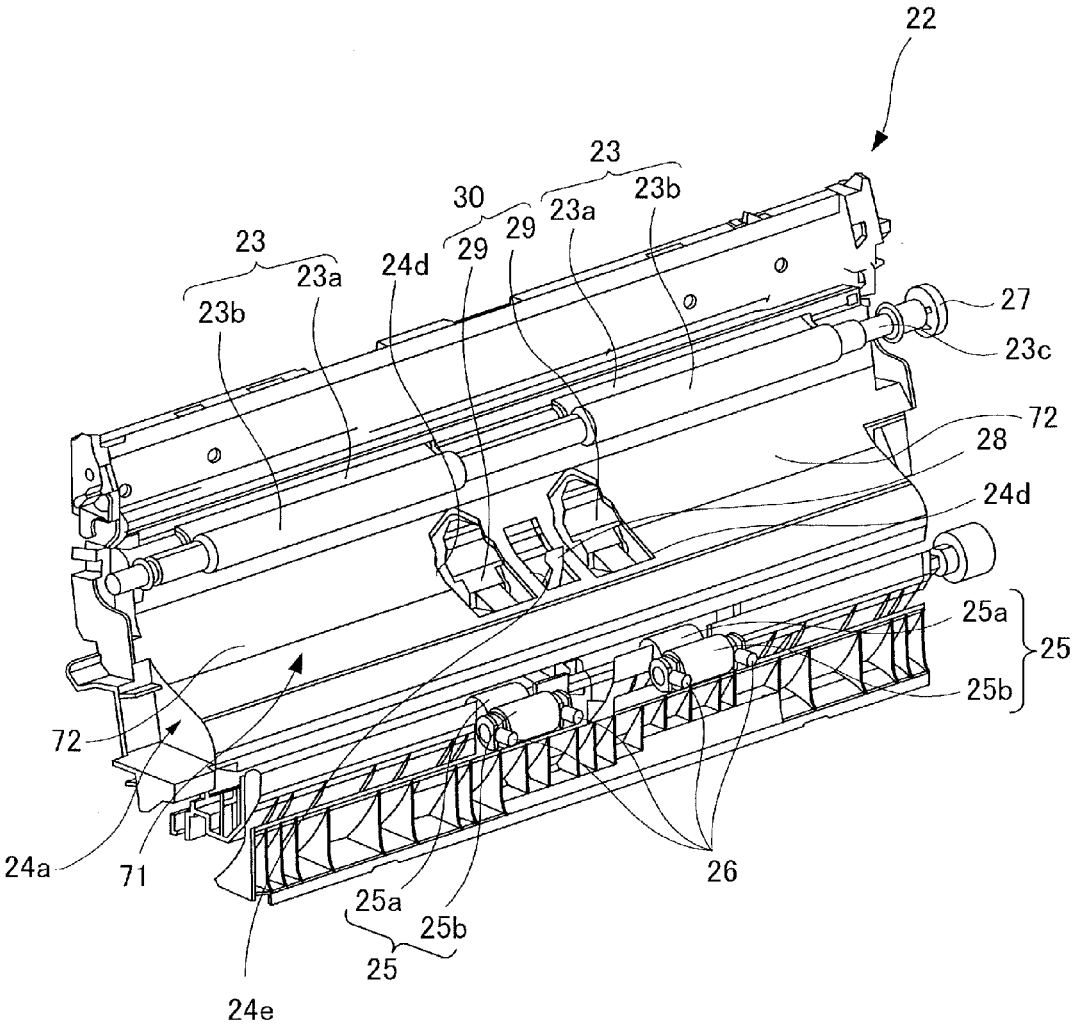
FIG. 2 is a perspective view illustrating a configuration of a registration unit provided in the sheet conveying apparatus.

Next, the registration unit 22 provided in the sheet conveying apparatus 105 of the present embodiment will be described. FIG. 2 is a perspective view illustrating a configuration from the pre-registration roller pair 25 to the registration roller pair 23 provided downstream of the pre-registration roller pair 25 and correcting a skew of the sheet P.

As shown in FIG. 2, the pre-registration roller pair 25 includes a first roller 25*a* whose circumferential surface is formed of rubber and a second roller 25*b* formed of polyacetal (POM). Then, the second roller 25*b* is disposed to face the first roller 25*a*, is supported so as to be movable with respect to the first roller 25*a*, and is in pressure contact with the first roller 25*a* by resilient force of a spring 26. It is noted that while the first and second rollers 25*a* and 25*b* are provided by two each in the present embodiment, the number of the respective rollers may be only one or three or more.

The registration roller pair 23 includes a driven roller 23*a* whose circumferential surface is formed of rubber and a driving roller 23*b* formed of polyacetal (POM). Then, the driven roller 23*a* is disposed to face the driving roller 23*b*, is supported so as to be movable with respect to the driving roller 23*b*, and is in pressure contact with the driving roller 23*b* by resilient force of a spring not shown. Still further, a gear 27 is attached to one end of a roller shaft 23*c* of the driving roller 23*b*, and the driving roller 23*b* and the driven roller 23*a* rotate as the roller shaft 23*c* rotates by receiving driving force from a driving motor not shown through the gear 27.

Here, a sensor 28 detecting position of the front end of the sheet conveyed by the pre-registration roller pair 25 is provided between the pre-registration roller pair 25 and the registration roller pair 23. Then, based on detection information of the sensor 28, the control portion 120 stops the registration roller pair 23 and abuts the sheet P conveyed by the pre-registration roller pair 25 against the registration roller pair 23 being stopped. After that, the control portion 120 conveys the sheet P by the pre-registration roller pair 25 by a predetermined distance to form a loop of a predetermined length and to abut the front end of the sheet against the nip portion of the registration roller pair 23 to correct a skew of the sheet P.

Figure 3:
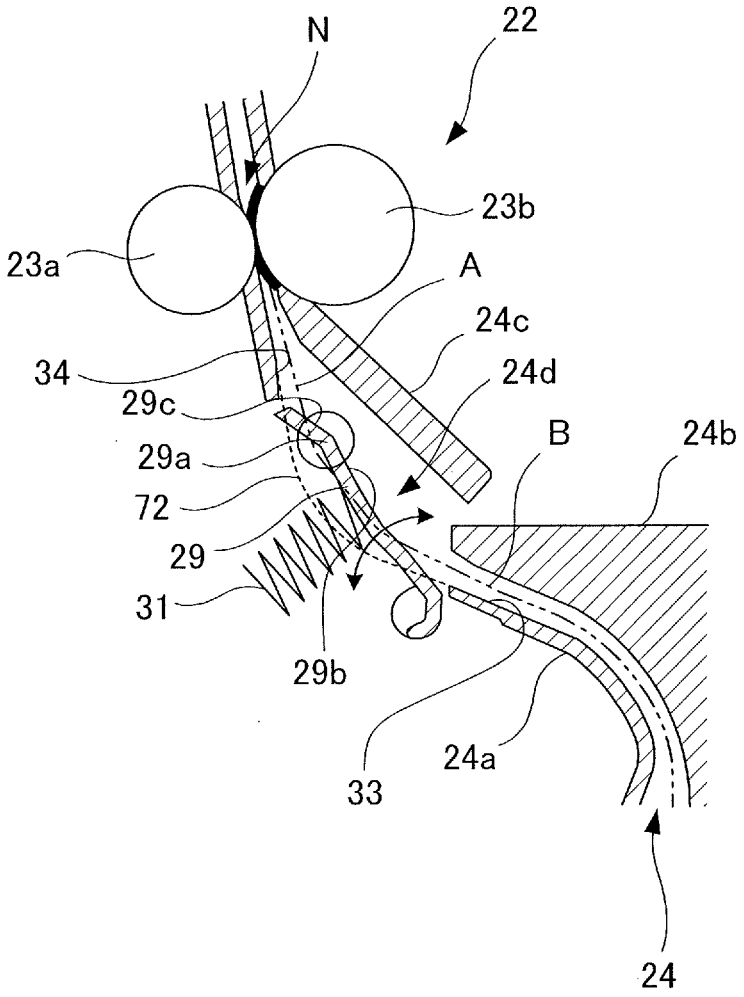
FIG. 3 is a sectional side view illustrating the registration unit in a state in which a turnable guide is located at a projecting position.

As shown in FIGS. 2 and 3, the curved conveying path is formed by a curved outer guide 24*a* (curved guide) including a curved portion 71, a curved inner guide 24*b* and an upper guide 24*c* (leading guide) facing the curved outer guide 24*a*. The curved portion 71 is provided with two opening portions 24*d* arrayed in the width direction and with an opening 24*e*.

Turnable guides 29 and the sensor 28 are turnably supported by the curved outer guide 24*a*. The two turnable guides 29 project out to the curved conveying path 24 through the opening portions 24*d*. Still further, the sensor 28 is biased by a spring not shown so that the sensor 28 projects out to the curved conveying path 24 through the opening 24*e* to be able to detect the front end of the sheet. The turnable guides 29 are disposed in the curved portion 71 so as to overlap in the sheet width direction and are configured to be turnable between a projecting position where the turnable guide 29 projects to the curved conveying path 24 and a recede position where the turnable guide 29 recedes in a direction of approaching from the projecting position to the curved outer guide 24*a* in FIG. 3. The two turnable guides 29 constitute a moving portion 30.

The turnable guides 29 are biased to the projecting position by springs 31 (biasing portions), respectively. While two of the springs 31 are provided to two turnable guide 29 in the present embodiment, it is also possible to arrange such that the two turnable guides 29 are biased to the projecting position by one spring 31. It is noted that spring force of the spring 31 is arranged such that the spring 31 exhibits a bias force that turns the turnable guide 29 even for a sheet having relatively less stiffness such as a thin sheet and a recycled sheet.

By the way, in a case when a sheet is conveyed askew, one end in the width direction orthogonal to the sheet conveying direction of the sheet arrives early at the registration roller pair 23 and another widthwise end of the sheet arrives lately at the registration roller pair 23. In such a case, if the sheet is continuously conveyed, one end side of the sheet makes a large loop and approaches to the curved outer guide 24*a* and the other end side separates away from the curved outer guide 24*a*. As a result, because the other end side of the sheet is conveyed while floating in the air within the curved conveying path 24, a shape of the sheet becomes unstable, and in a case of conveying a non-stiff sheet in particular, there is a case when the sheet does not stably enter the nip portion N of the registration roller pair 23. In such a case, wrinkles and folds may be generated.

Then, according to the present embodiment, the curved outer guide 24*a* is provided with the two turnable guides 29, i.e., movable members, with a predetermined widthwise interval. It is noted that the two turnable guides 29 are provided at positions enabling to deal with a sheet whose widthwise length is narrow and are turnable respectively independently with respect to the curved conveying path 24. This arrangement makes it possible for the two turnable guides 29 to turn respectively independently corresponding to a skew direction and a skew amount of the sheet P.

Then, the sheet P is conveyed along the turnable guides 29 to the registration roller pair 23 while stabilizing its shape regardless of the skew direction and the skew amount by turning the two turnable guides 29 independently. It is noted that the present embodiment is arranged such that the sheet P arrives at the turnable guide 29 after being detected by the sensor 28 so that the turn of the turnable guide 29 does not affect the detection timing of the sensor 28.

The turnable guide 29 includes an upstream slope 29*b* and a downstream slope 29*c* (inclined planes). Then, the curved outer guide 24*a* extends downstream in the sheet conveying direction of the turnable guide 29. The sheet that has passed through the curved conveying path 24 is guided to the nip portion N of the registration roller pair 23 by the curved outer guide 24*a* and the upper guide 24*c*, i.e., the leading guide.

It is noted that in the present embodiment, the upper guide 24*c* extends to an upper part of the turnable guide 29. This arrangement makes it possible to guide the sheet to a position between the upper guide 24*c* and the curved outer guide 24*a* and to the nip portion N of the registration roller pair 23 after passing through a part between the upper guide 24*c* and the turnable guide 29.

Here, according to the present embodiment, the upstream slope 29*b* of the turnable guide 29 is inclined such that the further downstream in the sheet conveying direction, the narrower a distance between the turnable guide 29 and the upper guide 24*c* becomes. That is, the further downstream in the sheet conveying direction, the more the upstream slope 29*b* is inclined in a direction of approaching the upper guide 24*c*. The downstream slope 29*c* of the turnable guide 29 is inclined such that the further downstream in the sheet conveying direction, the wider the distance between the upper guide 24*c* and the turnable guide 29 becomes. That is, the further downstream in the sheet conveying direction, the more the downstream slope 29*c* inclines in a direction of separating from the upper guide 24*c*. In other words, the turnable guide 29 bends at a project portion 29*a* (bent portion), i.e., a boundary between the upstream slope 29*b* and the downstream slope 29*c*.

The project portion 29*a* of the turnable guide 29 is located near a nip line A, i.e., a tangential line of the nip portion N of the registration roller pair 23. It is noted that the project portion 29*a* of the turnable guide 29 is also located in a vicinity of a sheet conveying path B formed by the curved outer guide 24*a* and the curved inner guide 24*b*. This arrangement makes it possible to cause the sheet P to enter the nip portion N of the registration roller pair 23 straightly even in a case when the sheet P is conveyed by passing through the project portion 29*a* without turning the turnable guide 29 as described later.

Here, the curved outer guide 24*a* is provided with a guide plane 72 (indicated by a dot line in FIG. 3) extending along the sheet conveying direction on sides of the turnable guide 29 in the width direction orthogonal to the sheet conveying direction as shown and described in FIG. 2. Still further, as shown in FIGS. 3 and 5, the curved outer guide 24*a* includes an upstream guide plane 33 formed upstream in the sheet conveying direction of the turnable guide 29 and guiding the sheet to the turnable guide 29 and a downstream guide plane 34 formed downstream of the turnable guide 29 and guiding the sheet to the nip portion N.

Figure 4:
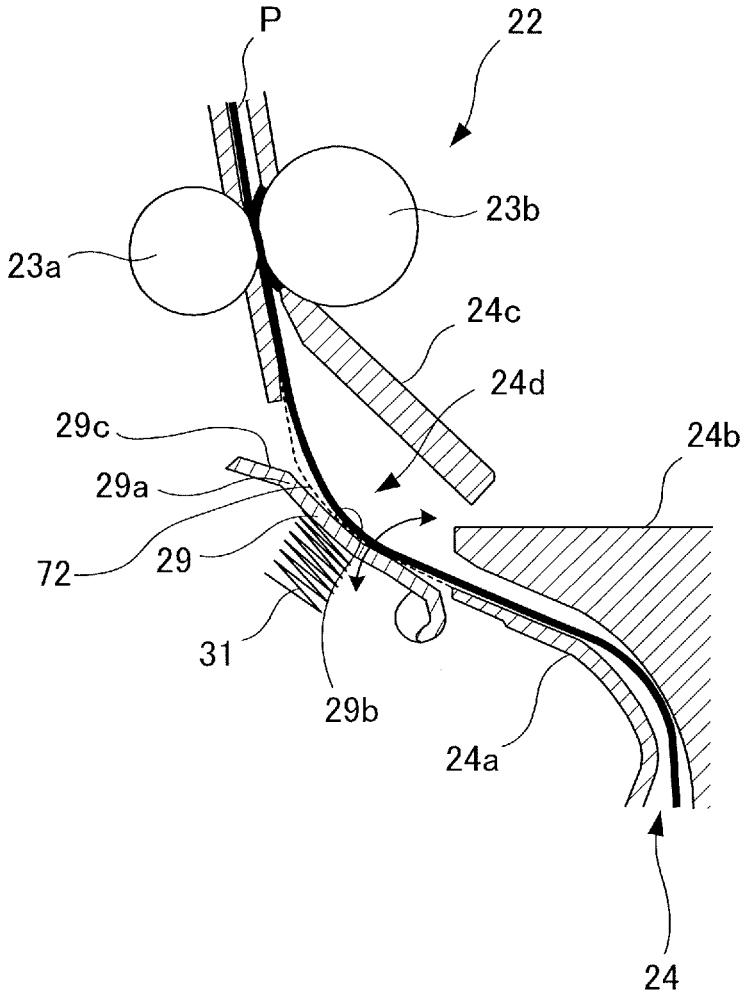
FIG. 4 is a sectional side view illustrating the registration unit in a state in which the turnable guide is located at a recede position.

Still further, as shown in FIG. 4, the turnable guide 29 is configured to be turnable to a position where the project portion 29*a* is substantially coincident with the guide plane (outline) 72 of the curved outer guide 24*a*. That is, the project portion 29*a* and the upstream slope 29*b* are formed to run along the guide plane 72 when the turnable guide 29 is located at the recede position. Then, because the turnable guide 29 turns to such position, it is possible to assure a loop space necessary for correcting a skew at upstream of the nip portion N of the registration roller pair 23.

Next, a sheet skew correcting operation of the registration unit 22 including the turnable guide 29 and others constructed as described above will be described. It is noted that the explanation will be made below focusing only on an operation of one turnable guide among the two turnable guides 29 and an explanation of the other turnable guide will be omitted here.

Firstly, a skew correcting operation of a relatively stiff sheet P1, such as a thick sheet and a coated sheet, whose stiffness is greater than a predetermined stiffness will be described with reference to FIGS. 5A through 5C. The operation is applied to a thick sheet of 80 g/mm$^2$ or more in the present embodiment. Here, because the bias force of the spring 31 is set as described above, the stiffness of the sheet overcomes the bias force of the spring 31 in conveying the stiff sheet P1. Therefore, the sheet P1 is conveyed while turning the turnable guide 29 from the projecting position to the recede position by the front end thereof as shown in FIG. 5A.

Figure 5A:
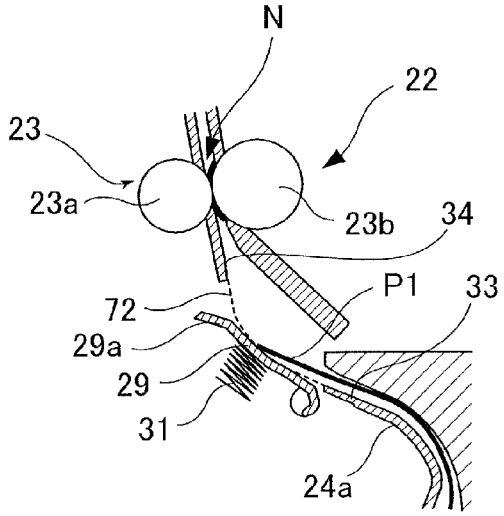
FIG. 5A is a sectional side view illustrating a state in which a front end of a stiff sheet presses the turnable guide.

Then, as shown also in FIG. 5A, the guide plane 72 of the curved outer guide 24*a* guides the front end of the sheet P1 when the sheet P1 turns the turnable guide 29 to the recede position by the front end thereof. Accordingly, it is possible to guide the sheet stably by the guide plane 72 even if the turnable guide 29 is turned by the relatively stiff sheet P1. Therefore, in the present embodiment, it is possible to restrain such conveyance failure that the sheet deviates out of the conveying path and jams otherwise from occurring due to the turn of the turnable guide 29 being pressed by the stiff sheet P1.

After that, the front end of the sheet P1 passes through the turnable guide 29 and reaches the downstream guide plane 34 of the curved outer guide 24*a*. At this time, the sheet P1 becomes straight by the stiffness thereof on a basis of the front end of the sheet as shown in FIG. 5B. It is because the sheet P1 is supported by the upstream and downstream guide planes 33 and 34 with the turnable guide 29 between them. Thereby, the sheet P is conveyed without running along the turnable guide 29, so that the turnable guide 29 returns in a direction of the projecting (standby) position.

Next, even if the sheet P1 abuts against the registration roller pair 23, the pre-registration roller pair 25 continuously conveys the sheet P1 in this state, so that the sheet P1 forms a loop. At this time, the sheet P1 forms the loop so as to run along the guide plane 72 of the curved outer guide 24*a* while turning the turnable guide 29 downward as shown in FIG. 5C, so that a skew of the sheet is corrected.

Figure 5B:
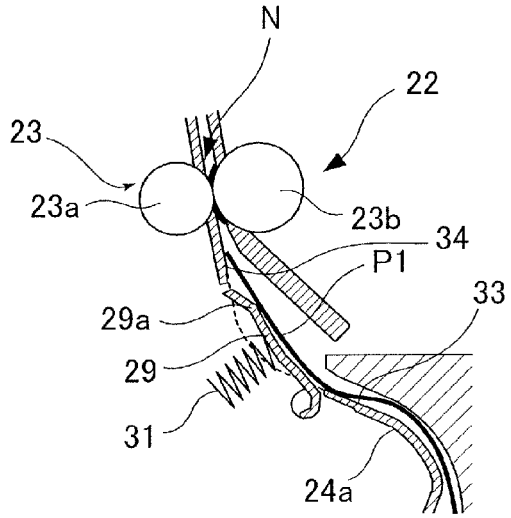
FIG. 5B is a sectional side view illustrating a state in which the front end of the stiff sheet passes through the turnable guide and arrives at a curved outer guide.

It is noted that a mode in which the turnable guide 29 returns toward the projecting position is exemplified in FIGS. 5A and 5B. However, it is also possible to arrange such that the front end of the sheet arrives at the registration roller pair 23 while keeping the turnable guide 29 at the position (recede position) shown in FIG. 5A. In such a case, the deflection of the sheet increases at the upstream side of the turnable guide 29 and the front end of the sheet follows the nip line after when the front end of the sheet has arrived at the registration roller pair 23.

Figure 6A:
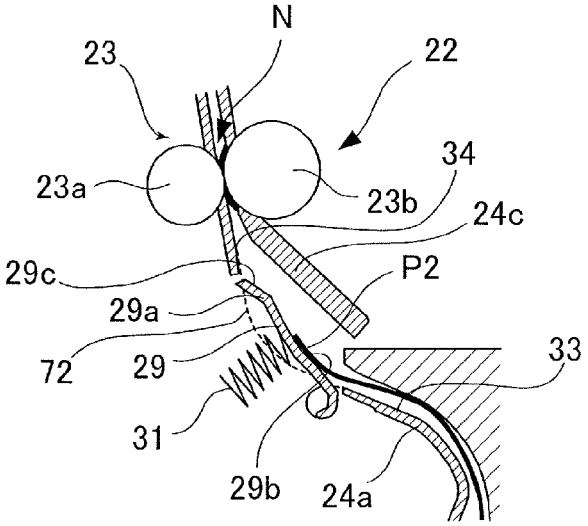
FIG. 6A is a sectional side view illustrating a state in which a front end of a non-stiff sheet arrives at the turnable guide.
Figure 6B:
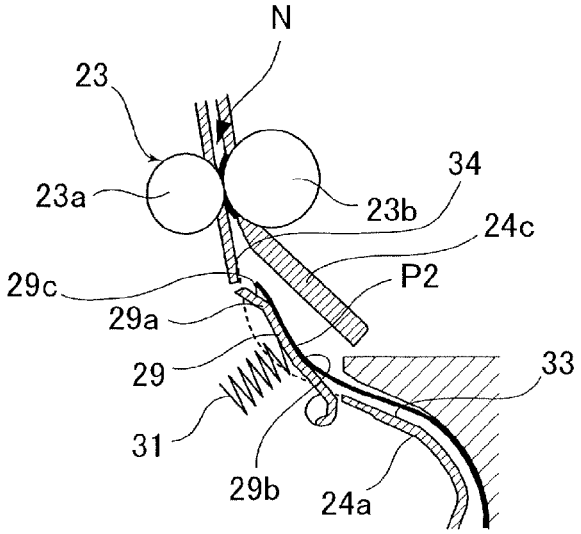
FIG. 6B is a sectional side view illustrating a state in which the front end of the non-stiff sheet arrives at a bent portion of the turnable guide.

Next, a skew correcting operation of a sheet P2 whose stiffness is relatively weak such as a thin sheet and a recycled sheet whose stiffness is less than a predetermined stiffness will be described with reference to FIGS. 6A through 6C. Here, in the case of conveying the non-stiff sheet P2, the sheet P2 is conveyed along the turnable guide 29 as shown in FIG. 6A without turning the turnable guide 29 from the projecting position because the sheet P2 is not conveyed while overcoming the bias force of the turnable guide 29. That is, the bias force of the spring 31 is set such that the turnable guide 29 does not move from the projecting position even if the turnable guide 29 is pressed by the front end of the sheet P2. Because the sheet P2 is conveyed without turning the turnable guide 29 even after that as shown in FIG. 6B until when the sheet P2 abuts against the registration roller pair 23, the turnable guide 29 is kept being located at the projecting position.

Here, the project portion 29*a* of the turnable guide 29 is located near the nip line A, i.e., the tangential line of the nip portion N of the registration roller pair 23 and the conveying path B of the curved conveying path 24 (see FIG. 3) as described above. Therefore, the sheet P2 can enter the nip portion N of the registration roller pair 23 straightly even if the turnable guide 29 is located at the projecting position and hardly buckles.

Then, the sheet P2 abuts against the registration roller pair 23 and the pre-registration roller pair 25 continuously conveys the sheet P2 in this state, so that the sheet P2 gradually forms a loop. Soon after that, the turnable guide 29 is pressed from the projecting position to the recede position by being pressed by the looped sheet P2 as shown in FIG. 6C, and the loop is formed along the curved outer guide 24*a*, so that it becomes possible to correct a skew of the sheet.

It is noted that the downstream slope 29*c* of the turnable guide 29 is inclined such that the further the curved conveying path 24 advances in the sheet conveying direction, the wider the distance between the turnable guide 29 and the upper guide 24*c* becomes as described above. Therefore, in the case of conveying the non-stiff sheet P2, the sheet P2 moves along the downstream slope 29*c* of the turnable guide 29 after passing over the project portion 29*a* of the turnable guide 29. After that, the sheet P arrives smoothly the downstream guide plane 34 of the curved outer guide 24*a* and is conveyed along the downstream guide plane 34. As a result, the sheet P2 can be conveyed stably to the nip portion N without receiving any stress.

Figure 5C:
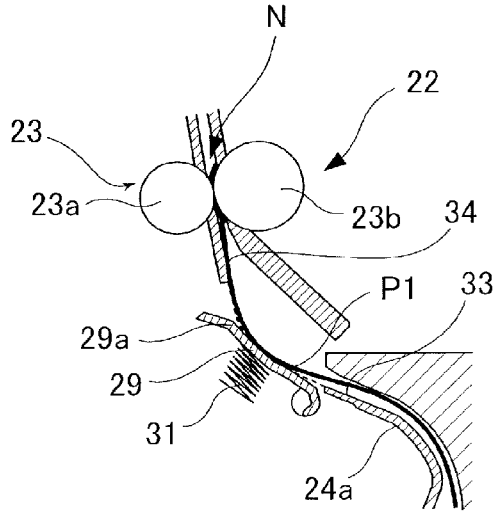
FIG. 5C is a sectional side view illustrating a state in which the stiff sheet forms a loop.
Figure 6C:
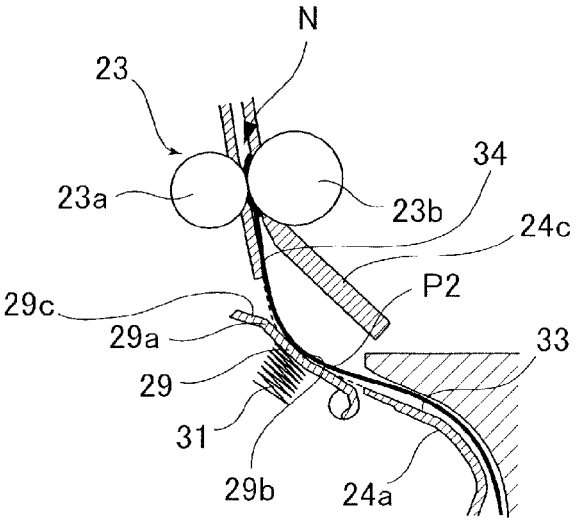
FIG. 6C is a sectional side view illustrating a state in which the non-stiff sheet forms a loop.

Here, when FIG. 5C is compared with FIG. 6C, it can be seen that the sheets assume similar shapes after abutting against the registration roller pair 23. That is, the loops by which a skew of the sheets can be corrected are formed. As a result, it becomes possible to stably correct a skew.

As described above, according to the present embodiment, the turnable guide 29 is provided so as to project to the curved conveying path 24 from the curved portion 71 of the curved outer guide 24*a* and guides the sheet that has been conveyed by the pre-registration roller pair 25 to the nip portion N of the registration roller pair 23. Then, the turnable guide 29 turns from the projecting position to the recede position by being pressed by the sheet when the sheet whose stiffness is greater than the predetermined stiffness heads toward the registration roller pair 23 and when the sheet abuts against the registration roller pair 23 and bends.

Still further, even if the turnable guide 29 moves from the recede position by being pressed by the front end of the sheet, the turnable guide 29 returns to the projecting position by the stiffness of the sheet and the bias force of the spring 31 before the front end of the sheet arrives at the nip portion N of the registration roller pair 23.

Still further, while the turnable guide 29 does not turn even if it is pressed by the sheet whose stiffness is less than the predetermined stiffness heads toward the registration roller pair 23, the turnable guide 29 turns by being pressed by the sheet when the sheet bends by abutting against the registration roller pair 23. Then, it becomes possible to conduct the sheet skew correcting operation by arranging such that the turnable guide 29 does not turn even if it is pressed by the sheet whose stiffness is less than the predetermined stiffness heads toward the registration roller pair 23 and turns by being pressed by the sheet when the sheet bends.

That is, the sheet skew correcting operation can be stably conducted because the sheet can form the loop regardless of its stiffness by arranging as described in the present invention.

Still further, the turnable guide 29 is disposed so as to overlap with the guide plane 72 of the fixed curved outer guide 24*a* in the sheet width direction in the present embodiment. Therefore, even if the turnable guide 29 turns by being pressed by the front end of the sheet, the guide plane 72 can guide the front end of the sheet. Accordingly, it is possible to restrain the conveyance failure such as jamming otherwise caused by the deviation of the sheet out of the conveying path and damage to the sheet from occurring.

It is noted that the case where the two turnable guides 29 are turnably provided in the width direction has been described in the present embodiment, the number of the turnable guides may be three or more, or the same advantageous effects can be obtained even if the number is only one. It is noted that while the turnable guide 29 has been exemplified as the moving member in the above description, the turnable guide 29 may be modified such that it is reciprocable (slidable) in a thickness direction of the sheet to be conveyed.

Still further, while a skew of the sheet is corrected by abutting the sheet against the nip portion N of the registration roller pair 23 in the present embodiment, the present invention is not limited to such arrangement. That is, any configuration may be adopted as long as the abutment portion abutting with the sheet and forming the loop is provided. For instance, it is possible to arrange such that a skew of the sheet is corrected as the sheet abuts against a shutter member biased by a spring.

Still further, while the pre-registration roller pair 25, i.e., the first conveying portion, and the registration roller pair 23, i.e., the second conveying portion, are constructed by the roller pairs, the present invention is not limited to such arrangement. That is, one of both of the rollers of the pre-registration roller pair 25 and the registration roller pair 23 may be composed of another rotating body such as a belt.

It is also noted that while the mode of biasing the turnable guide 29 to the projecting position by means of the spring 31 has been exemplified in the present embodiment, the present invention is not limited to such configuration. For instance, it is also possible to configure such that the turnable guide 29 is biased to the projecting position by own weight of the turnable guide 29.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-174821, filed on Aug. 29, 2014, and Japanese Patent Application No. 2015-149424, filed on Jul. 29, 2015, which are hereby incorporated by reference herein in its entirety.

What is claimed is:

1. A sheet conveying apparatus, comprising:

a first conveying portion conveying a sheet;

a second conveying portion including an abutment portion against which a front end of the sheet conveyed by the first conveying portion abuts and conveying the sheet;

a curved guide including a curved portion and forming a curved sheet conveying path between the first and the second conveying portions;

an opposed guide opposing the curved guide and forming the sheet conveying path together with the curved guide; and a moving portion disposed to overlap with the curved portion in a width direction orthogonal to a sheet conveying direction and movable between a projecting position where the moving portion projects to the sheet conveying path and a recede position where the moving portion recedes in a direction approaching to the curved guide from the projecting position, the moving portion being moved from the projecting position to the recede position by being pressed by the sheet as the sheet is conveyed by the first conveying portion in a state in which the front end of the sheet abuts against the abutment portion, wherein the moving portion comprises a downstream slope inclined such that the further downstream in the sheet conveying direction, the more the downstream slope separates from the opposed guide, and an upstream slope formed upstream of the downstream slope in the sheet conveying direction and inclined such that the further downstream in the sheet conveying direction, the more the upstream slope approaches the opposed guide, and the downstream and upstream slopes are configured to guide the sheet conveyed by the first conveying portion.

2. The sheet conveying apparatus according to claim 1, further comprising a bias portion biasing the moving portion to the projecting position such that the moving portion moves from the projecting position to the recede position by being pressed by the front end of the sheet in a case where stiffness of the sheet being conveyed is greater than a predetermined stiffness and such that the moving portion does not move even if the moving portion is pressed by the front end of the sheet in a case where stiffness of the sheet is less than the predetermined stiffness.

3. The sheet conveying apparatus according to claim 2, wherein the moving portion moves from the recede position to the projecting position by a bias force of the bias portion in response to an arrival of the front end of the sheet, whose stiffness is greater than the predetermined stiffness, to the curved guide by passing through the moving portion.

4. The sheet conveying apparatus according to claim 2, wherein the moving portion includes a plurality of moving members arrayed in the width direction and movable between the projecting position and the recede position, and wherein the bias portion includes a plurality of bias members biasing the plurality of moving members to the projecting positions, respectively.

5. The sheet conveying apparatus according to claim 1, wherein the second conveying portion is a roller pair, the abutment portion is a nip portion formed by the roller pair, and the moving portion includes a bent portion formed near a tangential line of the nip portion when the moving portion is located at the projecting position and between the downstream slope and the upstream slope of the moving portion.

6. The sheet conveying apparatus according to claim 1, wherein the curved guide includes an upstream guide plane formed upstream, in the sheet conveying direction, of the moving portion and guiding the sheet to the moving portion, and a downstream guide plane formed downstream of the moving portion and upstream of the abutment portion in the sheet conveying direction and guiding the sheet to the abutment portion.

7. An image forming apparatus comprising:

an image forming portion forming an image on a sheet; and the sheet conveying apparatus as set forth in claim 1 conveying the sheet to the image forming portion.

8. The sheet conveying apparatus according to claim 1, wherein the second conveying portion includes a pair of rollers configured to convey the sheet nipped by a nip portion of the pair of rollers, and a tangential line of the pair of rollers in the nip portion intersects with the downstream slope of the moving portion.

9. A sheet conveying apparatus, comprising:

a conveying portion configured to convey a sheet;

a pair of rollers against which a front end of the sheet conveyed by the conveying portion abuts and which conveys the sheet nipped by a nip portion of the pair of rollers;

a moving portion disposed between the conveying portion and the pair of rollers, and configured to move by being pressed by the sheet as the sheet is conveyed by the conveying portion in a state in which the front end of the sheet abuts against the nip portion; and an opposed guide disposed to be opposed to the moving portion such that a sheet conveyed by the conveying portion passes between the moving portion and the opposed guide, wherein the moving portion is movable between a first position and a second position further from the opposed guide than the first position, and comprises a convex portion being formed to be convex so as to project toward the opposed guide, the convex portion comprises:

a first guide portion arranged to guide the sheet conveyed by the conveying portion; and a second guide portion disposed downstream of the first guide portion in a sheet conveying direction such that a tip of the convex portion is located between the first guide portion and the second guide portion in the sheet conveying direction, and arranged to guide the sheet conveyed by the conveying portion, and a tangential line which is tangent to both of the pair of rollers in the nip portion intersects with the second guide portion in a case where the moving portion is located at the first position.

10. The sheet conveying apparatus according to claim 9, further comprising a sensor provided between the conveying portion and the moving portion in the sheet conveying direction and detecting the front end of the sheet.

11. The sheet conveying apparatus according to claim 9, wherein the second guide portion is inclined such that the further downstream in the sheet conveying direction, the more the second guide portion separates from the opposed guide, and the first guide portion is inclined such that the further downstream in the sheet conveying direction, the more the first guide portion approaches the opposed guide.

12. The sheet conveying apparatus according to claim 11, further comprising a curved guide comprising a curved portion and forming a curved sheet conveying path between the conveying portion and the pair of rollers, wherein the moving portion is disposed to overlap with the curved portion in a width direction orthogonal to the sheet conveying direction, projects to the sheet conveying path at the first position, and recedes from the sheet conveying path at the second position, the moving portion being moved from the first position to the second position by being pressed by the sheet as the sheet is conveyed by the conveying portion in the state in which the front end of the sheet abuts against the nip portion.

13. The sheet conveying apparatus according to claim 12, further comprising a bias portion biasing the moving portion to the first position such that the moving portion moves from the first position to the second position by being pressed by the front end of the sheet in a case where stiffness of the sheet being conveyed is greater than a predetermined stiffness and such that the moving portion does not move even if the moving portion is pressed by the front end of the sheet in a case where stiffness of the sheet is less than the predetermined stiffness.

14. The sheet conveying apparatus according to claim 9, wherein the moving portion comprises a plurality of moving members arrayed in a width direction, and the plurality of moving members are movable independently.

15. The sheet conveying apparatus according to claim 9, wherein the moving portion is turnably supported.

16. The sheet conveying apparatus according to claim 9, further comprising a curved guide comprising a curved portion and forming a curved sheet conveying path between the conveying portion and the pair of rollers, wherein the curved guide comprises an opening portion through which the moving portion is configured to project to the sheet conveying path.

17. The sheet conveying apparatus according to claim 9, further comprising a sensor provided between the conveying portion and the moving portion in the sheet conveying direction and detecting the front end of the sheet.

18. An image forming apparatus comprising:

an image forming portion forming an image on a sheet; and the sheet conveying apparatus as set forth in claim 9 conveying the sheet to the image forming portion.

19. The sheet conveying apparatus according to claim 9, wherein the further downstream in the sheet conveying direction, the more the second guide portion separates from a line connecting the tip of the convex portion and the nip portion.

20. The sheet conveying apparatus according to claim 9, further comprising a biasing portion configured to bias the moving portion toward the first position, wherein the moving portion moves by being pressed by the conveyed sheet against a biasing force of the biasing portion.

21. The sheet conveying apparatus according to claim 9, wherein further downstream in the sheet conveying direction, the more the second guide portion separates from a line along the first guide portion.

22. The sheet conveying apparatus according to claim 9, wherein the convex portion includes a bent portion, having the tip of the convex portion, which connects the first guide portion and the second guide portion.

* * * * *